US011427444B2

(12) United States Patent
Michel

(10) Patent No.: US 11,427,444 B2
(45) Date of Patent: Aug. 30, 2022

(54) CABLE ROTATION BLOCKING SYSTEM

(71) Applicant: Goodrich Corporation, Charlotte, NC (US)

(72) Inventor: Adrien Michel, Maisons-Laffitte (FR)

(73) Assignee: Goodrich Corporation, Charlotte, NC (US)

( * ) Notice: Subject to any disclaimer, the term of this patent is extended or adjusted under 35 U.S.C. 154(b) by 281 days.

(21) Appl. No.: 16/707,979

(22) Filed: Dec. 9, 2019

(65) Prior Publication Data

US 2020/0307963 A1 Oct. 1, 2020

(30) Foreign Application Priority Data

Apr. 1, 2019 (EP) ..... 19305431

(51) Int. Cl.
*B66C 13/04* (2006.01)
*B66C 1/34* (2006.01)

(52) U.S. Cl.
CPC ..... *B66C 13/04* (2013.01); *B66C 1/34* (2013.01)

(58) Field of Classification Search
CPC .. B66C 1/22; B66C 1/34; B66C 13/04; B66C 13/06; B66C 13/10; F16G 11/12
USPC ..... 294/82.1
See application file for complete search history.

(56) References Cited

U.S. PATENT DOCUMENTS 1,525,090 A * 2/1925 Rutan ..... B66C 1/34 294/82.16
1,676,167 A * 7/1928 Sprain ..... E21B 19/04 294/82.23
2,556,165 A * 6/1951 Christensen ..... B66D 3/06 254/401
2,625,005 A * 1/1953 Myers ..... B66C 1/34 59/95
2,651,533 A * 9/1953 Miller ..... B66C 1/34 59/95
3,009,728 A * 11/1961 Breslav ..... B66C 1/34 294/82.15

(Continued)

FOREIGN PATENT DOCUMENTS

CN 105084239 A 11/2015
GB 642474 9/1950

(Continued)

OTHER PUBLICATIONS

EPO Search Report for Application No. 19305431.9 dated Oct. 10, 2019; 7pp.

*Primary Examiner* — Paul T Chin
(74) *Attorney, Agent, or Firm* — Snell & Wilmer L.L.P.

(57) ABSTRACT

A cable rotation blocking system (CRBS) (300) is described herein. The CRBS extends along an axis X between a first end (305) and a second end (303), and comprises a first section provided at the first end (305), the first section being configured to be connectable to a cable (100). The CRBS further comprises a second section provided at the second end (303), the second section being configured to be attachable to a load. With the CRBS described herein, when no load, or a load up to an upper load threshold is attached to the second section, the second section is rotatable about the axis X, relative to the first section, however, when a load higher than the upper load threshold is attached to the second section, the second section is prevented from rotation about the axis relative to the first section.

15 Claims, 5 Drawing Sheets

(56) References Cited

U.S. PATENT DOCUMENTS

| | | | | | |
|---|---|---|---|---|---|
| 3,179,461 | A * | 4/1965 | Rose | B66C 1/34 | 294/82.33 |
| 3,633,961 | A | 1/1972 | Speransky et al. | | |
| 4,708,382 | A * | 11/1987 | LaCount | B66C 1/34 | 59/95 |
| 4,762,355 | A * | 8/1988 | Hogg | B66C 1/125 | 294/82.12 |
| 5,156,430 | A * | 10/1992 | Mori | B66C 1/36 | 294/82.23 |
| 5,588,188 | A | 12/1996 | Jermyn, Jr. | | |
| 8,424,169 | B2 * | 4/2013 | Gammell | A43C 1/00 | 24/115 G |
| 8,608,215 | B2 * | 12/2013 | Passmann | B66C 1/34 | 59/95 |
| 2010/0206655 | A1 * | 8/2010 | Stilwell | B60T 13/04 | 180/370 |
| 2014/0299437 | A1 * | 10/2014 | Seillier | F16D 13/58 | 192/66.32 |

FOREIGN PATENT DOCUMENTS

| | | | | |
|---|---|---|---|---|
| JP | 2851787 | B2 | * | 1/1999 |
| JP | 7228468 | A | | 1/1999 |
| JP | 2007001754 | A | * | 1/2007 |
| WO | 201607796 | A1 | | 1/2016 |
| WO | 2018090104 | A1 | | 5/2018 |

* cited by examiner

CABLE ROTATION BLOCKING SYSTEM

CROSS-REFERENCE TO RELATED APPLICATIONS

This application claims priority to European Patent Application Serial No. 19305431.9, filed on Apr. 1, 2019, entitled "CABLE ROTATION BLOCKING SYSTEM." The contents of the foregoing application is hereby incorporated by reference for all purposes.

FIELD

The present disclosure relates to a cable rotation blocking system. In particular, the systems described herein may be used with cables that are employed as hoists.

BACKGROUND

Rescue hoists often comprise wire ropes or cables that have both inner and outer strands. In some examples, the cables are produced so as to be rotation resistant, and in these cases, the inner strands are wound in one direction and the outer strands are wound in the opposite direction. The objective of such rotation resistant wire ropes or cables is to balance the torque of the inner and outer strands to avoid any cable rotation when one end is free to swivel. In examples wherein the cables are not rotation resistant, the cables may be wound in one direction only.

JP7228468A describes a crane hook rotation preventing mechanism. U.S. Pat. No. 5,588,188A describes a swaged cable swivel hook assembly. WO2018090104A1 describes an apparatus for controlling orientation of suspended loads. CN105084239A describes a lifting hook device. U.S. Pat. No. 3,633,961 A describes a powered crane hook disconnect and an overload device.

SUMMARY

A cable rotation blocking system (CRBS) is described herein that extends along an axis X between a first end and a second end. The CRBS comprises a first section provided at its first end, the first section having means that is configured to be connectable to a cable. The CRBS also comprises a second section provided at its second end that has means that is configured to be attachable to a load. When no load, or a load up to an upper load threshold is attached to the second section, the second section is rotatable about the axis X, relative to the first section, however, when a load higher than the upper load threshold is attached to the second section, the second section is prevented from rotation about the axis relative to the first section.

In some examples the first section comprises a first body and the second section comprises a second body. When a load that is higher than the upper load threshold is attached to the second section, a surface of the first body contacts a surface of the second body, thereby preventing said rotation of the second section about said axis X relative to said first section.

In some examples described herein, the first section may comprise an external body and the second section may comprise an internal body provided internally of this external body. When a load that is higher than the upper load threshold is attached to the second section, an outer surface of the internal body may come into contact and abut an internal surface of the external body, thereby preventing rotation of the second section about the axis X relative to the first section In some examples, the CRBS may be used in reverse to that example, so that the first section (i.e. that section that is attachable to the cable) may comprise an internal body and the second section (i.e. that section which is attachable to the load) may comprise an external body. In such an example, the external body could be attached to the load and the internal body attached to the cable via the attachment means described herein.

Again, the internal body could be provided inside the external body and rotation could be blocked when the outer surface of the internal body comes into contact with and abuts an internal surface of the external body, thereby preventing rotation of the first section about the axis relative to the second section.

In any of the examples described herein, the external body may comprise an internal ledge that extends radially inwardly towards the internal body. The internal body may comprise an external ledge that extends radially outwardly towards the internal surface of the body. When a load higher than the upper load threshold load is attached to the second section, a surface of the outwardly extending ledge of the internal body may come into contact and abut a surface of the inwardly extending ledge of the external body, thereby preventing the rotation of the first section about the axis X relative to the first section.

In some examples described herein, the first section may further comprise means for connecting the cable to the first end of the body, and may further comprise a bearing holder provided internally of the body and a bearing shim washer in contact with the bearing holder. The means for connecting the cable the bearing holder and the bearing shim washer may be fixedly attached to each other so that they cannot move relative to each other.

In some examples described herein, the second section may further comprise a load attachment means that is attached to the internal body and configured for attaching the load to the internal body, wherein the load attachment means is fixedly attached to the internal body so that they cannot move relative to each other.

In other examples the second section may comprise a cable connection means that is attached to the internal body and configured to connect the cable to the internal body. In this example, a load attachment means would then be connected to the external body (first section) of the CRBS.

In any of the examples described herein, the load attachment means may comprise a hook.

In any of the examples described herein, the internal body of the second section may be fixedly attached to the load attachment means via a nut.

In any of the examples described herein, the second section may further comprises a hook wheel, and the hook wheel, the internal body and the load attachment means may be fixedly attached to each other.

In any of the examples described herein the CRBS may further comprise a shim washer provided internally of the external body and spring washers positioned between an outer surface of the internal body and a surface of the shim washer.

In any of the examples described herein, the internal body may comprise a lip provided on its outer surface and the spring washers may be compressible between the lip and the surface of the shim washer upon axial movement of the internal body in the direction of the load along the axis X.

In any of the examples described herein, the internal body that is attached to the load or cable may be preloaded. In some examples, this may be achieved using a spring washer, or some other spring technology in combination with a shim washer. Other means for providing a preload may also be used.

In any of the examples described herein, when a load that is lower than a preload threshold is attached to the second section, the second section is not able to translate but is able to rotate along the axis X in relation to the first section.

In any of the examples described herein, when a load that is higher than a preload threshold is attached to the second section, the second section is able to translate and rotate along the axis X in relation to the first section.

In any of the examples described herein, when the load that is higher than the upper load threshold is attached to the second section, the second section is not able to translate neither rotate along the X axis in relation to the first section.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

Figure 1A:
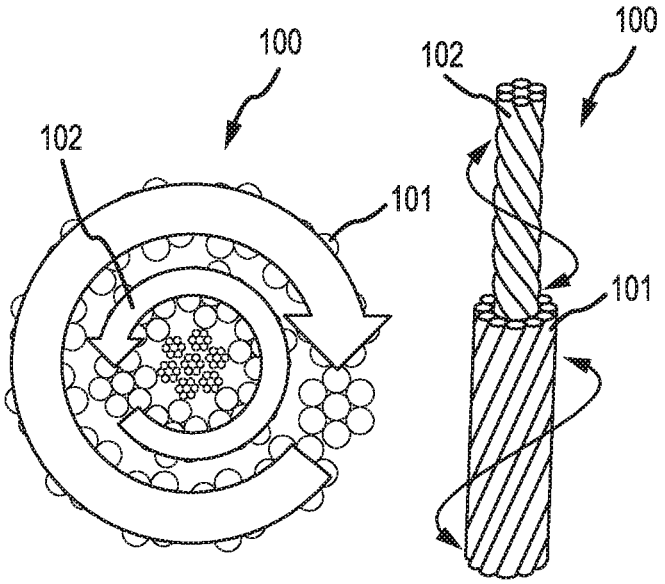
FIGS. 1*a* and 1*b* illustrate an example of a rotation resistant cable which has inner and outer strands, under load.

The examples described herein relate to a cable rotation blocking system.

As mentioned above, the objective of rotation resistant cables is to balance the torque of the inner 102 and outer 101 strands to avoid any cable 100 rotation when one end is free to swivel. In real life, however, when the rotation resistant ropes 100 are loaded, the torque may not be perfectly balanced, which thereby leads to some cable rotations. Hence, the cable outer strands 101 tend to unwind and elongate when loaded, whilst the inner strands 102 are tightened and shortened.

Figure 1B:
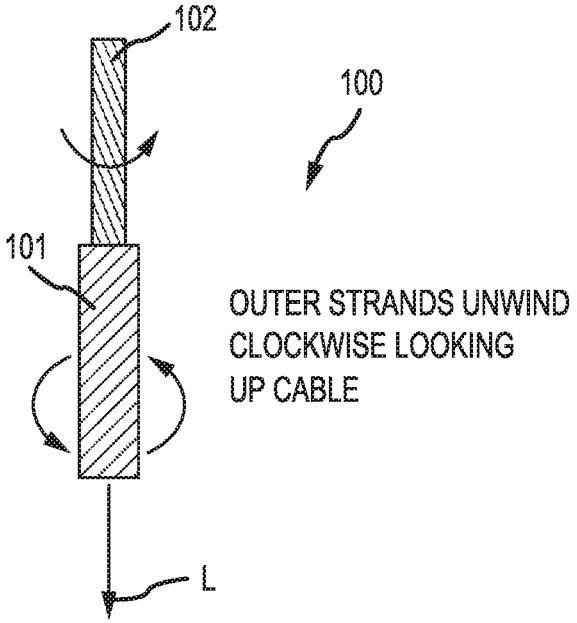

FIGS. 1*a* and 1*b* depicts a rotation resistant cable 100 showing this. As can be seen, when a high load L (e.g. 400 daN) is applied, and the cable is rotating in the clockwise direction, the outer strands become unwound direction (in this example, the outer strands 101 unwind clockwise), whereas the inner strands become tightened (by being wound in a clockwise twist). Therefore, it can be seen that when such a high load is applied, the torque between the inner and outer strands is not perfectly balanced (as the torque in the outer strands 101 is higher than the torque in the inner strands 102). This leads to an unequal load repartition between inner 102 and outer strands 101 and results in the cable rotating in a clockwise direction. As a major part of the load is only carried by the inner strands 102, this phenomenon can therefore drastically reduce the cable breaking strength. If the load is low, these phenomena are not sufficient to damage the cable.

If, on the other hand, both cable end rotations are blocked, then the load is evenly distributed between the inner and outer strands and the maximum breaking strength is ensured. During hoisting operations, however, the cable should be free to swivel in order to allow the load to rotate freely and independently of the cable. For this reason, ultimate load tests such as that shown in FIG. 2 are performed on cables with a cable end that is free to swivel during operating conditions.

Figure 2:
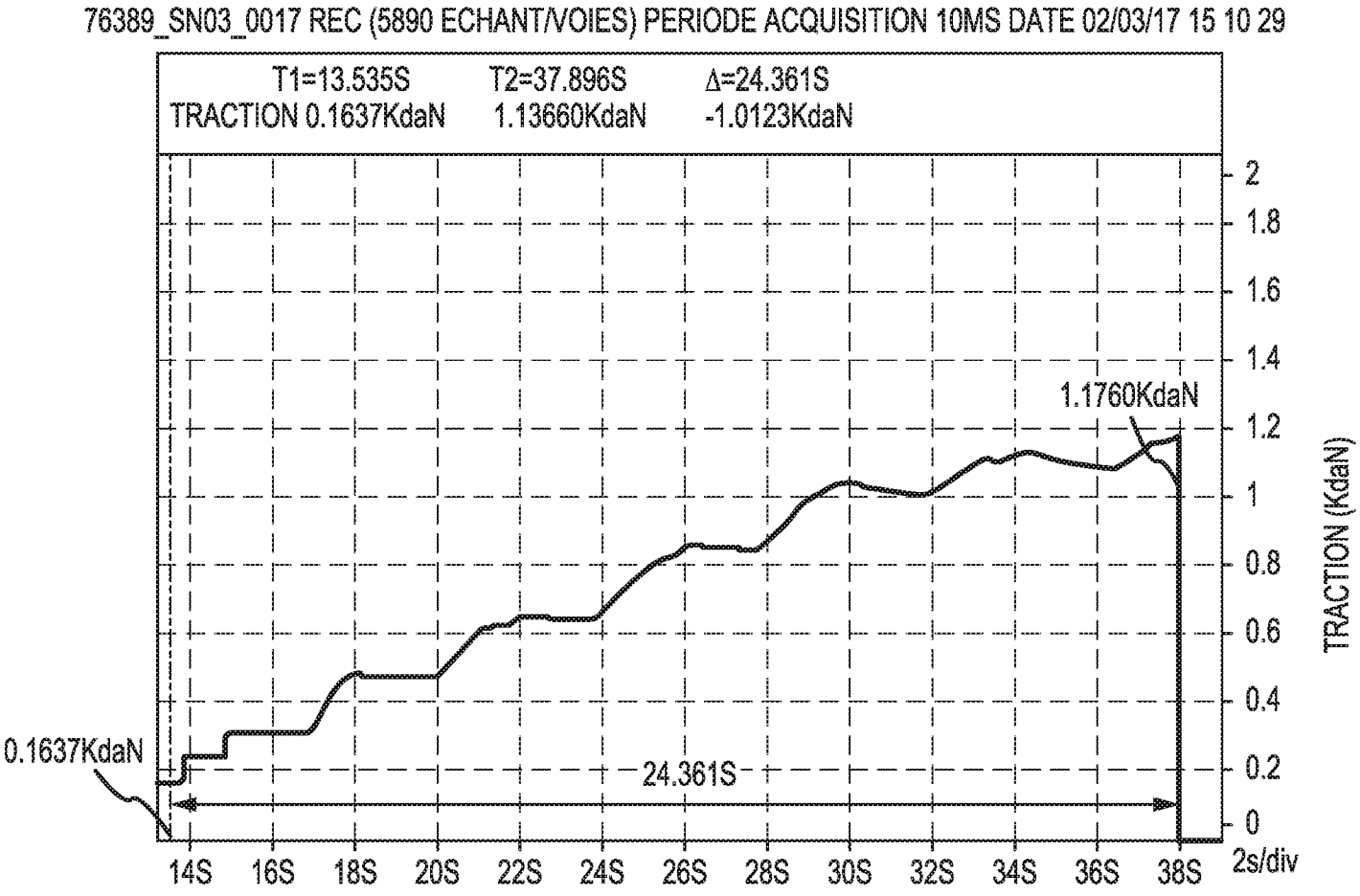
PRIOR ART FIG.2
FIG. 2 depicts the results of an ultimate load tests performed on a cable that has one end that is free to swivel/rotate and is not using the cable rotation blocking system (CRBS) described herein.

As can be seen in FIG. 2, the ultimate load tests performed with a cable end free to swivel all fail at around 1200 daN.

In situations wherein the cable end has been blocked, the ultimate load tests performed with the cable end blocked succeeded with a load of 1403 daN that was sustained for more than three seconds. For example, a 1403 daN load can be held by a cable with a hook that is not swiveling. Such hooks, however, cannot be used during operations, as it is required that the hook is free to swivel under normal operational loads. That is, the cable will achieve maximum strength as long as both ends are not free to swivel.

It was previously assumed that the cable ends need to be blocked in order to ensure that maximum cable strength is achieved under the ultimate load test. On the other hand, however, the operational needs of these cables require that the load attached to the cable is free to swivel.

As described below, the examples of the new cable rotating locking systems described herein are able to dramatically improve the cable performance under such ultimate load tests, despite these known limitations.

A Cable Rotation Blocking System (CRBS) 300 will now be described in detail with reference to FIGS. 3, 4*a* and 4*b*. The examples described herein may use a cable 100 having an inner set of strands 102 and an outer set of strands 101 as described above. In use, means 310 may be provided for connecting the cable 100 to a first end 305 of the CRBS. The CRBS 300 comprises a load attachment means 390 at the opposite end 303 of the cable attachment means 310 so that, in use, the CRBS 300 is positioned between the cable 100 and the load. The examples described herein refer to the use of a hook 390 as the load attachment means, however, the CBRS 300 is not limited to this and other load attachment means may alternatively be used. The load hook 390 is configured to be able to swivel or rotate under normal operating loads.

In the examples described herein, a CRBS 300 with a unique rotation locking means is positioned between the load and the cable 100. As described below, this new CRBS 300 has unique rotation locking features that prevent/block the hook 390 and therefore load from rotation at loads that are above an upper threshold level. Since the CRBS 300 prevents the hook 390 and the cable 100 from being rotatable relative to each other at high loads, this therefore also prevents any further rotation of the cable 100. An example of this is shown in FIG. 3.

Figure 3:
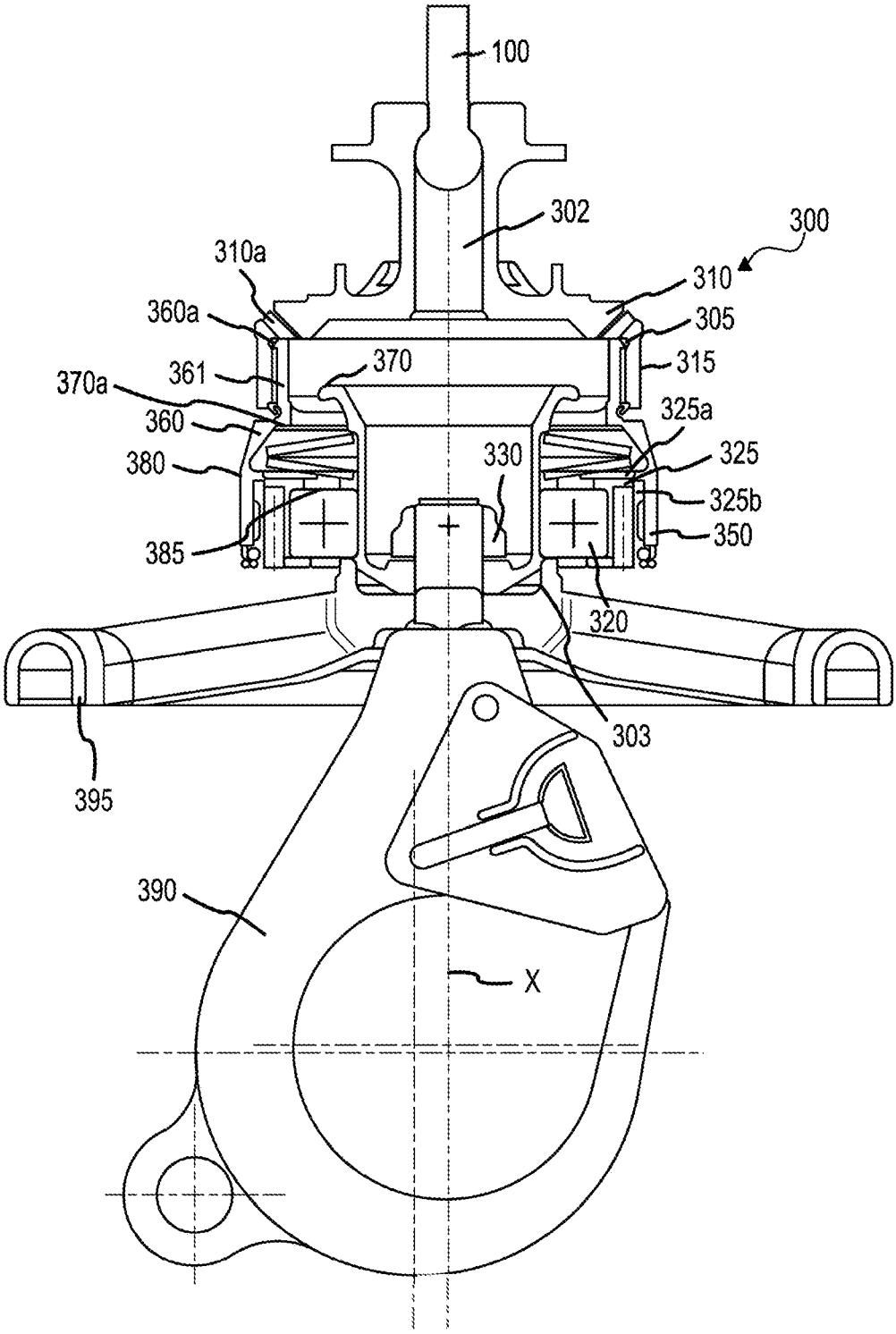
FIG. 3 depicts an example of a CRBS described herein.

Specifically, FIG. 3 depicts an example of this new CBRS 300. The CRBS can be described as having two distinct, main sections which are able to either a) axially move and/or rotate relative to each other, or b) be blocked from axially moving and/or rotating, relative to each other, depending on the amount of load that is attached.

In summary, it can be said that the first section comprises, amongst other features, an external body 360, means 310 for connecting the cable 100 to a first end 305 of this body 360, as well as a bearing holder 350. The bearing holder 350 is provided internally of the body 360 and a bearing shim washer 325 having a first, upper side 325*a*, and a second, lower side 325*b* is also provided so as to be in contact with the bearing holder 350 at its lower side 325*b*. These features 360, 310, 350, 325 of this first section are fixedly attached to each other so that they cannot move relative to each other.

The second section of the CRBS 300 comprises, amongst other features, an internal body 370 that is provided within this body 360 of the first section and a load attachment means 390, 395 that is fixedly attached to the internal body 370. These features 370, 390 and 395 of the second section are also fixedly attached to each other through a nut 330. Since these features 370, 390, 395, 330 of the second section are fixedly attached together, they rotate and translate axially together and are fixed to the load through the hook 390.

The first section and the second section of the CRBS 300 are linked together via the use of additional features including a bearing 320 (which is provided so as to be in contact with the second, lower side 325*b* of the bearing shim washer 325), a shim washer 385 and spring washers 380 (which are in contact with the shim washer 385). In particular, the bearing 320 allows for the rotation of the first section relative to the second section and the shim washer 385 allows for the preloading of the spring washers 380, as described below.

When a particular load is attached to the CRBS, these two sections are arranged relative to each other and via these linking features, so that the sections are either able to axially move or rotate relative to each other, or are prevented from rotation, depending on the amount of load that is attached.

The individual features of the CRBS 300 are now described in detail with reference to FIG. 3. The CRBS has a first end 305 and a second end 303 and a central axis X extending between these ends 305, 303. The first end 305 is connectable to a cable connection means 310. In some examples, the cable connection means 310 may be threaded and screwed onto the body 360 of the CRBS 300. This connection may also be achieved in other ways.

In some examples, the cable connection means 310 and the CRBS body 360 may be connected to each other due to the fact that the cable connection means 310 has a cup-shaped section 315 which has an open end facing the CRBS body 360. The CRBS body 360 may in turn be bell-shaped as shown in FIG. 3 and the smaller end 361 of the bell-shape may be shaped and sized so that it can be inserted into the open cup-shaped section 315 of the cable connecting device 310. The external surface of the CRBS body 360 and the internal surface of the cup-shaped cable connection means 310 may each/either have connecting features which allow the two components to be locked into place relative to each other. The example shown in FIG. 3 comprises a thread 360*a* provided on the outer surface of the body 360 and a corresponding thread 310*a* provided on the internal surface of the cable connection means 310, however, other means may be envisaged. In some examples, this CRBS body 360 may have different shape, such as conical but would still be able to connect in the same manner.

In use, the cable 100 is connected/attached at the first end 305 of the CRBS 300 via this cable connection means 310 that may be provided at, and connectable to, the first end 305 (i.e. the upper end in use) of the CRBS 300. In the example shown in FIG. 3, the cable 100 is connected using a cable swage terminal. That is, in the example shown here, the cable connection means 310 comprises a channel 302 shaped and sized so as to be able to receive a cable swage terminal of the cable 100. The cable 100 has an enlarged section (i.e. the swage terminal) at the end that is within the channel 302, thereby preventing it from being removed. The swage terminal is therefore received within the channel 302 but the channel 302 is configured to also prevent removal of the cable 100 from the channel 302 once it has been inserted. The cable 100 is held in place in this channel 302 via the swage terminal. Alternative types of cable connection means 310 may also be used than are described here.

A bearing holder 350 is provided internally of the body 360 of the CRBS, positioned between the inner surface of the body 360 and the outer surface of the internal component 370. A bearing 320 is mounted within this bearing holder 350.

Means, in this case, a bearing shim washer 325, may also be provided that allows the features of the cable connection means 310 and the body 360 as well as the bearing holder 350 to be held in a fixed position with the outside ring of the bearing 320.

As described above, the second section of the CRBS 300 comprises an internal body 370, which is provided internally of the CRBS body 360. The central axis X extends through the center of both the body 360 as well as the internal body 370 as shown in FIG. 3.

In some examples, this internal body 370 may also be bell-shaped, as shown, however, this is not necessary. The internal body 370 is mounted inside the bearing 320 so that it extends along the axis X and through the center of the bearing 320, as shown in FIG. 3. Spring washers 380 are also provided internally of the CRBS body 360 and between the inner surface of the body 360 and the outer surface of the internal body 370 so that they contact the outer surface of the internal body 370.

A shim washer 385 may also be provided between the spring washers 380 and the bearing 320. In some examples, the outer surface of the internal body 370 may have a lip 370*a* provided thereon, and the spring washer 380 may be held in place relative to the internal body 370 by being positioned between this lip 370*a* and the upper surface of the shim washer 385.

In use, the load is attached to the CRBS 300 via a load attachment means, which in this example is a hook 390 that is fixed to the internal body 370. In the example shown in FIG. 3, this fixation is achieved using a nut 330, however, other fixation means may be used. The hook 390 therefore extends out from inside the body 300 at its second end 303 (i.e. opposite the first end 305 at which the cable 100 is attached). The fixing together of the internal body 370 and the hook 390 with a nut 330 means that these components are never able to rotate in relation to each other.

A hook wheel 395 may also be provided. The hook wheel 395 main function is to provide a means for the hoist operator to handle the hook easily. Another function of the wheel 395 is to provide a shimming of the inside ring of the bearing 320, such that the features of the internal body 370 and the spring washers 380 cannot translate freely upward.

As mentioned above, the first section and the second section are linked together through the bearing 320, the shim washer 385 and the spring washers 380. Specifically, the internal body 370 and the spring washers 380 are linked to the body 360 and the bearing holder 350 via the bearing 320. The bearing 320 allows rotation of the first section compared to the second section.

As described in detail below, at certain loads, the internal body 370 and the spring washers 380 can rotate freely compared to the CRBS body 360 and the cable connection means 310, hence the load can rotate freely compared to the cable 100.

The shim washer 385 allows for preloading of the spring washers 380.

That is, when no load is attached, or a load is attached that is below the preload threshold value (i.e. an initial, relatively small load that is lower than the upper load threshold), then the second section (including the internal body 370) does not translate axially along the axis X compared to the second section (and the body 360), due to this preload. In this situation, the first section (i.e. which is connected to the cable) can rotate relative the second section.

In addition, when no load is attached, or a load is attached that is below a preload threshold value, the first section of the CRBS can rotate relative to the second section. That is, the cable 100 is able to rotate relative to the load.

When the preload threshold value is reached, however, the internal body 370 of the second section moves axially in the direction of the load and compresses the spring washers 380. This axial movement relative to the body 360 results in compression of the spring washers 380 between the lip 370*a* and the shim washer 385. These spring washers 380 are then compressed between a surface of the internal body 370 (e.g. the lip 370*a* provided on its outer surface) and the upper surface of the shim washer 385 as the internal body 370 translates axially in the direction of the load. If the load attached is above the preload value but still below an upper threshold load, then the internal body 370 and its associated features can translate axially as well as rotationally about the axis X.

Therefore, in summary, when the load is above the preload threshold but still below the upper load threshold, the internal body 370 and the features of the second section that are fixed thereto are able to translate axial movement along the central axis X in the direction of the load relative to the first section. In these conditions, first section can also still rotate relative to second section. Although spring washers 380 are described herein with reference to FIGS. 3 to 6, the examples are not limited to this and any other type of spring means or spring technology may be used.

Since the axial translation of these movable parts (i.e. the second section) compared to the fixed parts (i.e. the first section) induces the compression of spring washers 380, the threshold load (at which the rotation is blocked between the fixed and moving parts) can be set to a wanted value thanks to the shim washer 385, since it preloads the spring washers 380. The thicker the shim washer 385, the higher the spring washers 380 preload will be and the higher the threshold load at which the rotation will be blocked will also be.

In this way, the shim washer 385 allows for this preload of the spring washers 380, and thereby allows to set the upper threshold load at which the spring washers 380 will be totally compressed and at which the rotation will be blocked, as described below.

Therefore, in use, when the hook 390 is being loaded to above a certain preload threshold, the internal body 370 is initially translating axially compared to the CRBS body 360 (by compressing the spring washers 380).

When the upper threshold load is reached, however, the axial translation and rotation of the internal body 370 and its associated features are totally blocked. This is due to the spring washers 380 being completely compressed and the external surface of the internal body 370 coming into contact 410 with the internal surface of the CRBS body 360. In the situation wherein the contact between these two parts is a dog type, it blocks the rotation of the rotating parts (i.e. the second section) compared to the non-rotating parts (i.e. the first section). Hence the load rotation is blocked compared to the cable. When the load is removed, the second set of features associated with the internal body 370 revert back to their normal position as shown in FIG. 3 and rotation is possible again.

In summary, under the upper threshold load, the internal body 370 is able to rotate, however, once a threshold operational force (e.g. 400 daN) is reached, the spring washers 380 are compressed to a point at which the internal body 370 contacts a surface of the CRBS body 360 so that rotation of the internal body 370 is no longer possible. In some examples, the rotation may be blocked by a dog type blockage, such as is shown here, however, the examples described herein are not limited to this.

Figure 4:
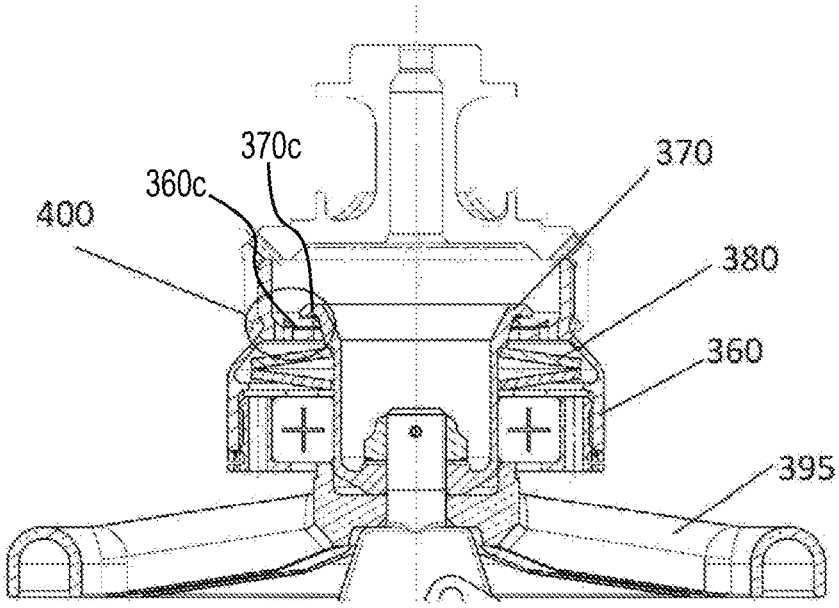
FIG. 4 depicts a CRBS wherein rotation is permitted.
Figure 5:
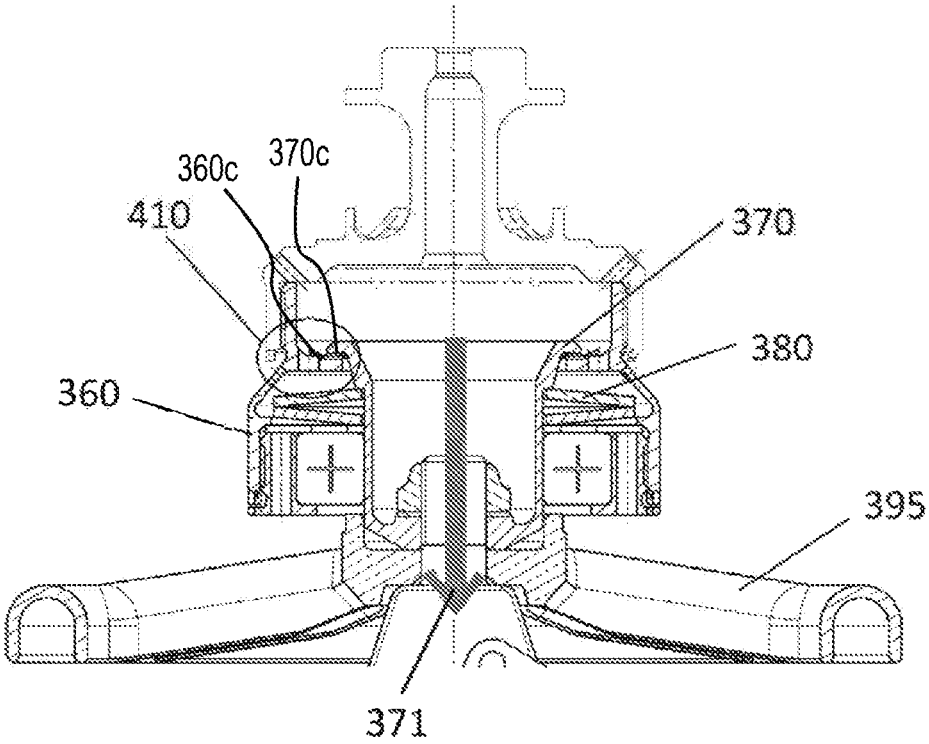
FIG. 5 depicts a CRBS wherein rotation is blocked.

This blocking of rotation is shown in more detail in FIGS. 4 and 5. For example, FIG. 4 depicts a situation wherein the force is less than the threshold (e.g. less than 400 daN), and rotation of the internal body 370 is allowed, since there is no contact 400 between the external surface of the internal body 370 and the internal surface of the CRBS body 360. In the examples shown in FIGS. 3 to 5, the external body 360 comprises an internal ledge 360*c* that extends radially inwardly towards the internal body 370. The internal body 370 also comprises an external ledge 370*c* that extends radially outwardly and therefore towards the internal surface of the body 360. As can be seen in FIG. 4, when the load applied is less than the upper load threshold, the ledges are not in contact with each other 400.

FIG. 5 depicts a situation wherein translation or movement 371 of the internal body 370 has occurred in the direction of the force being applied. As shown in FIG. 5, this moves the internal body 370 axially 371 in the direction of the load and results in the two ledges 360*c*, 370*c* coming into contact with each other 410. This prevents any further rotation of the internal body 370 relative to the body 360 and also prevents any further axial movement.

This therefore also prevents rotation of the cable 100 compared to the load. Although the upper threshold load is described here as being 400 daN, this upper threshold may be changed according to cable requirements. In some examples, the CRBS may be set to prevent rotation once the load reaches greater than 1.5 times the nominal load.

Figure 6:
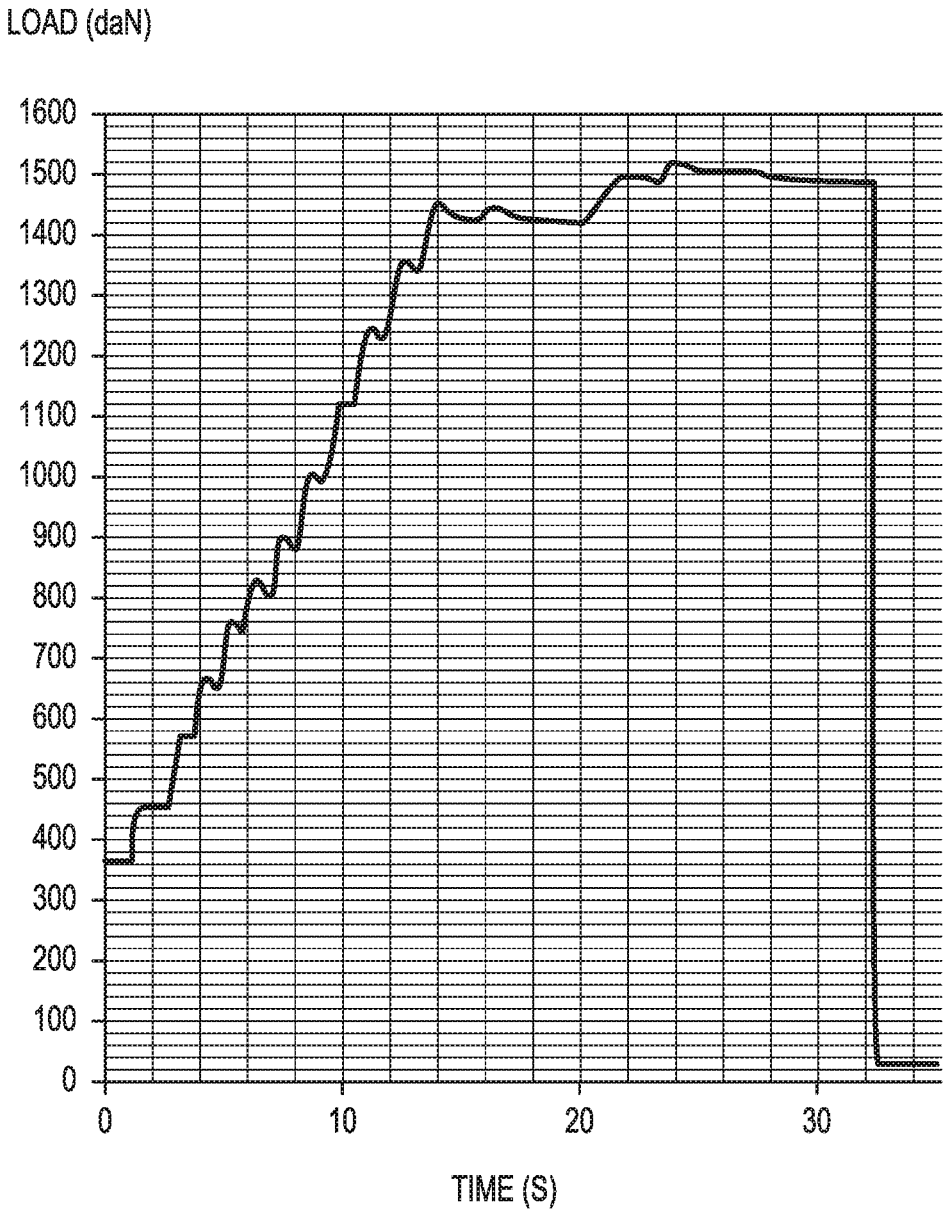
FIG. 6 depicts a graph showing the results of load tests performed with the CRBS shown in FIGS. 3, 4 and 5 performed under the same conditions as for the test from FIG. 2 but using the CRBS.

Although the examples described herein and shown with reference to the figures relate to a CRBS wherein the cable is attached, via a cable attachment means, to the external body, and the load is attached, via a load attachment means to the internal body, the CRBS may alternatively be used in the opposite way. That is, the CRBS could be used the other way round (upside down in comparison to FIGS. 3 to 5), so that the internal body is attached to the cable and the external body is attached to the load. In this situation, the CRBS arranged in this way would still function in the same way as described above. The examples described herein provide advantages over known hoist mechanisms. FIG. 6 depicts a graph which shows the results of an ultimate load test that was performed using the CRBS shown in FIGS. 3 to 5. As can be seen in this graph, the CRBS described herein allow a hoist to sustain a load of 1500 daN for more than three seconds without failure. In comparison, and as shown in FIG. 2, tests performed without this new type of CRBS 300 failed at around 1200 daN. The same cable type, with the same diameter and construction was used for both tests. The new examples of CRBS 300 described herein therefore allow for a significant increase in cable breaking strength; i.e. at least a 300 daN (+25%) improvement.

The invention claimed is:

1. A cable rotation blocking system (CRBS), comprising:
a first end;
a second end opposite the first end, wherein an axis extends from the first end to the second end;
a first section comprising a first body configured to be connectable to a cable, the first section being located at the first end; and
a second section comprising a second body configured to be attachable to a load, the second section being located at the second end;
a bearing located radially between the first body and the second body; and
a biasing member configured to bias the second body axially toward the first end, the biasing member being located axially between the bearing and the first end,
wherein the first section and the second section are configured such that when no load, or a load less than or equal to an upper load threshold is attached to the second body, the second body is rotatable about the axis and relative to the first body, and
wherein the first section and the second section are configured such that when a load greater than the upper load threshold is attached to the second body, the second body is prevented from rotation about the axis and relative to the first body.

2. The CRBS of claim 1 wherein the first section and the second section are configured such that when the load attached to the second body is greater than the upper load threshold, a first surface of the first body contacts a second surface of the second body and prevents rotation of the second body about the axis and relative to the first body.

3. The CRBS of claim 1, wherein the first body is located radially outward of the second body.

4. The CRBS of claim 3, wherein the first body comprises an internal ledge extending radially inwardly towards the second body, and wherein the second body comprises an external ledge extending radially outwardly towards the first body, and wherein the first body and the second body are configured such that when the load attached to the second body is greater than the upper load threshold, the external ledge contacts the internal ledge and prevents rotation of the second body about the axis and relative to the first body.

5. The CRBS of claim 1, wherein the first body is located radially inward of the second body.

6. The CRBS of claim 1, wherein the first section further comprises:
a means for connecting the cable to the first body;
a bearing holder provided radially inward of the first body, wherein the bearing is mounted in the bearing holder; and
a bearing shim washer in contact with the bearing holder, and wherein the means for connecting the cable, the first body, the bearing holder and the bearing shim washer are fixedly attached to each other so that they cannot move relative to each other.

7. The CRBS of claim 1 wherein the second section further comprises a load attachment means attached to the second body and configured for attaching the load to the second body, wherein the load attachment means is fixedly attached to the second body such that the load attachment means and the second body do not move relative to each other.

8. The CRBS of claim 7, wherein the load attachment means comprises a hook.

9. The CRBS of claim 7, wherein the second body of the second section is fixedly attached to the load attachment means via a nut.

10. The CRBS of claim 7, wherein the second section further comprises a hook wheel, and wherein the hook wheel, the second body and the load attachment means are fixedly attached to each other.

11. The CRBS of claim 1, further comprising a shim washer located radially inward of the first body, wherein the biasing member comprises spring washers positioned between the second body and the shim washer.

12. The CRBS of claim 11, wherein the second body comprises a lip provided on an outer surface of the second body, and wherein the spring washers are compressible between the lip and a surface of the shim washer.

13. The CRBS of claim 1, wherein the second section further comprises a means for providing a preload to the biasing member.

14. The CRBS of claim 13, wherein the means for providing the preload comprises a shim washer.

15. The CRBS of claim 1, wherein the first section and the second section are configured such that when the load attached to the second body is less than a preload threshold, the second body is not able to translate axially but is able to rotate about the axis and relative to the first body, and wherein the first section and the second section are configured such that when the load attached to the second body is greater than or equal to the preload threshold and less than the upper load threshold, the second body is able to translate axially and rotate about the axis and relative to the first body, and wherein the first section and the second section are configured such that when the load attached to the second body is greater than the upper load threshold, the second body is not able to translate axially and is not able to rotate about the axis and relative to the first body.

* * * * *